US005141573A

United States Patent [19]

Nakashima

[11] Patent Number: 5,141,573

[45] Date of Patent: Aug. 25, 1992

[54] HIGH FLUX DENSITY GRAIN-ORIENTED ELECTRICAL STEEL SHEET HAVING IMPROVED WATT LOSS CHARACTERISTIC AND PROCESS FOR PREPARATION THEREOF

[75] Inventor: Shozaburo Nakashima, Kitakyushu, Japan

[73] Assignee: Nippon Steel Corporation, Tokyo, Japan

[21] Appl. No.: 604,357

[22] Filed: Oct. 26, 1990

Related U.S. Application Data

[62] Division of Ser. No. 340,063, Apr. 18, 1989, abandoned.

[30] Foreign Application Priority Data

Apr. 23, 1988 [JP] Japan ..... 63-99328
Feb. 2, 1989 [JP] Japan ..... 1-22672

[51] Int. Cl.[5] ..... H01F 1/04
[52] U.S. Cl. ..... 148/111; 148/113
[58] Field of Search ..... 148/111, 112, 113

[56] References Cited

U.S. PATENT DOCUMENTS

| | | | |
|---|---|---|---|
| 3,238,073 | 3/1966 | Clark et al. | 148/308 |
| 3,278,348 | 10/1966 | Foster et al. | 148/111 |
| 3,940,299 | 2/1976 | Goto et al. | 148/111 |
| 4,645,547 | 2/1987 | Krause et al. | 148/307 |
| 4,753,692 | 6/1988 | Kuroki et al. | 148/111 |
| 4,863,531 | 9/1989 | Wada et al. | 148/111 |
| 4,863,532 | 9/1989 | Kuroki et al. | 148/307 |

FOREIGN PATENT DOCUMENTS

| | | |
|---|---|---|
| 0202339 | 11/1986 | European Pat. Off. . |
| 1483517 | 5/1969 | Fed. Rep. of Germany . |
| 2249957 | 5/1975 | France . |
| 2571884 | 4/1986 | France . |
| 55-18566 | 2/1980 | Japan . |
| 58-73724 | 5/1983 | Japan . |
| 61-96036 | 5/1986 | Japan . |
| 61-117218 | 6/1986 | Japan . |
| 61-117284 | 6/1986 | Japan . |
| 62-151511 | 7/1987 | Japan . |
| 848512 | 9/1960 | United Kingdom . |

OTHER PUBLICATIONS

Patents Abstracts of Japan, vol. 10, No. 56 (C-331) [2113] Mar. 26, 1986.
European Search Report EP 89 10 7068.

*Primary Examiner*—John P. Sheehan
*Attorney, Agent, or Firm*—Kenyon & Kenyon

[57] ABSTRACT

An electrical steel sheet having a very small watt loss can be provided by improving the conventional magnetic domain-controlling treatment. Namely, a high-flux density, grain-oriented electrical steel sheet having a superior watt loss characteristic and a flux density of at least 1.88 T at a magnetizing force of 800 A/m, which comprises, as the steel sheet components, up to 0.0030% by weight of C, 2.8 to 4.5% by weight of Si, 0.045 to 0.100% by weight of Mn, up to 0.0050% by weight of one or two elements selected from the group consisting of S and Se, up to 0.0050% by weight of Al, up to 0.0030% by weight of N, 0.03 to 0.25% by weight of Sn, 0.35 to 2.0% by weight of Ni and if necessary, 0.03 to 0.08% by weight of Cu, with the balance consisting of Fe and unavoidable impurities, wherein a tension coating is formed on the surface of a steel sheet and after the secondary recrystallization, the surface of the steel sheet is subjected to an artificial magnetic domain-controlling treatment in a direction substantially orthogonal to the rolling direction, and a process for the preparation of this steel sheet, are disclosed.

3 Claims, 7 Drawing Sheets

HIGH FLUX DENSITY GRAIN-ORIENTED ELECTRICAL STEEL SHEET HAVING IMPROVED WATT LOSS CHARACTERISTIC AND PROCESS FOR PREPARATION THEREOF

This application is a division of application Ser. No. 07/340,063 filed Apr. 18, 1989 now abandoned.

BACKGROUND OF THE INVENTION

1. Field of the Invention

The present invention relates to a grain-oriented electrical steel sheet and a process for the preparation thereof. More particularly, the present invention relates to a technique of providing a high-flux density, grain-oriented electrical steel sheet in which the watt loss characteristic is greatly improved by the magnetic domain-controlling treatment of the surface of the steel sheet.

2. Description of the Related Art

A process is known for reducing the watt loss by subjecting the surface of a high-flux density, grain-oriented electrical sheet to an artificial magnetic domain-controlling treatment in a direction substantially orthogonal to the rolling direction. More specifically, Japanese Unexamined Patent Publication No. 55-18566 and Japanese Unexamined Patent Publication No. 58-73724 disclose a process in which the surface of the electrical steel sheet is irradiated with laser beams at predetermined intervals; Japanese Unexamined Patent Publication No. 61-96036 discloses a process in which intrusions are formed at predetermined intervals; Japanese Unexamined Patent Publication No. 61-117218 discloses a process in which grooves are formed at predetermined intervals; Japanese Unexamined Patent Publication No. 61-117284 discloses a process in which a part of the base steel is removed at predetermined intervals and a phosphate-type tension coating is formed on the surface; and Japanese Unexamined Patent Publication No. 62-151511 discloses a process in which the surface of the electrical steel sheet is brought into contact with a plasma flame at predetermined intervals.

By the adoption of the above-mentioned technique of the artificial magnetic domain control, the watt loss characteristic can be considerably improved in a high-flux density, grain-oriented electrical steel sheet, and this technique has met current demands, i.e., to save energy, through a reduction of the watt loss in a transformer constructed by using this steel sheet.

Nevertheless, the requirements for saving energy are increasing, and it has become necessary to further enhance the performance of a grain-oriented electrical steel sheet as the material of a transformer.

SUMMARY OF THE INVENTION

A primary object of the present invention is to provide a product having a watt loss characteristic (lower watt loss) superior to that obtainable by the conventional magnetic domain-controlling treatment.

More specifically, a product having a much smaller watt loss is prepared by subjecting the surface of a high-flux density, grain-oriented electrical sheet, in which specific amounts of Sn and Ni are incorporated in combination and on which a high-tension coating is formed, to an artificial magnetic domain-controlling treatment in a direction substantially orthogonal to the rolling direction.

Furthermore, according to the present invention, a product having an especially superior watt loss characteristic is provided by incorporating a specific amount of Cu into the above-mentioned product or by adjusting the average grain size of crystal grains in the product to 11 to 50 mm.

More specifically, in accordance with the present invention, there is provided a high-flux density, grain-oriented electrical steel sheet having a superior watt loss characteristic and a flux density of at least 1.88 T at a magnetizing force of 800 A/m, which comprises, as the steel sheet components, up to 0.0030% by weight of C, 2.8 to 4.5 % by weight of Si, 0.045 to 0.100% by weight of Mn, up to 0.0050% by weight of one or two elements selected from the group consisting of S and Se, up to 0.0050% by weight of Al, up to 0.0030% by weight of N, 0.03 to 0.25% by weight of Sn, 0.35 to 2.0% by weight of Ni, and if necessary, 0.03 to 0.08% by weight of Cu, with the balance consisting of Fe and unavoidable impurities, wherein a tension coating is formed on the surface of the steel sheet, and after the secondary recrystallization, the surface of the steel sheet is subjected to an artificial magnetic domain-controlling treatment in a direction substantially orthogonal to the rolling direction. Furthermore, in accordance with the present invention, there is provided a process for the preparation of this steel sheet.

DESCRIPTION OF THE PREFERRED EMBODIMENTS

Figure 1:
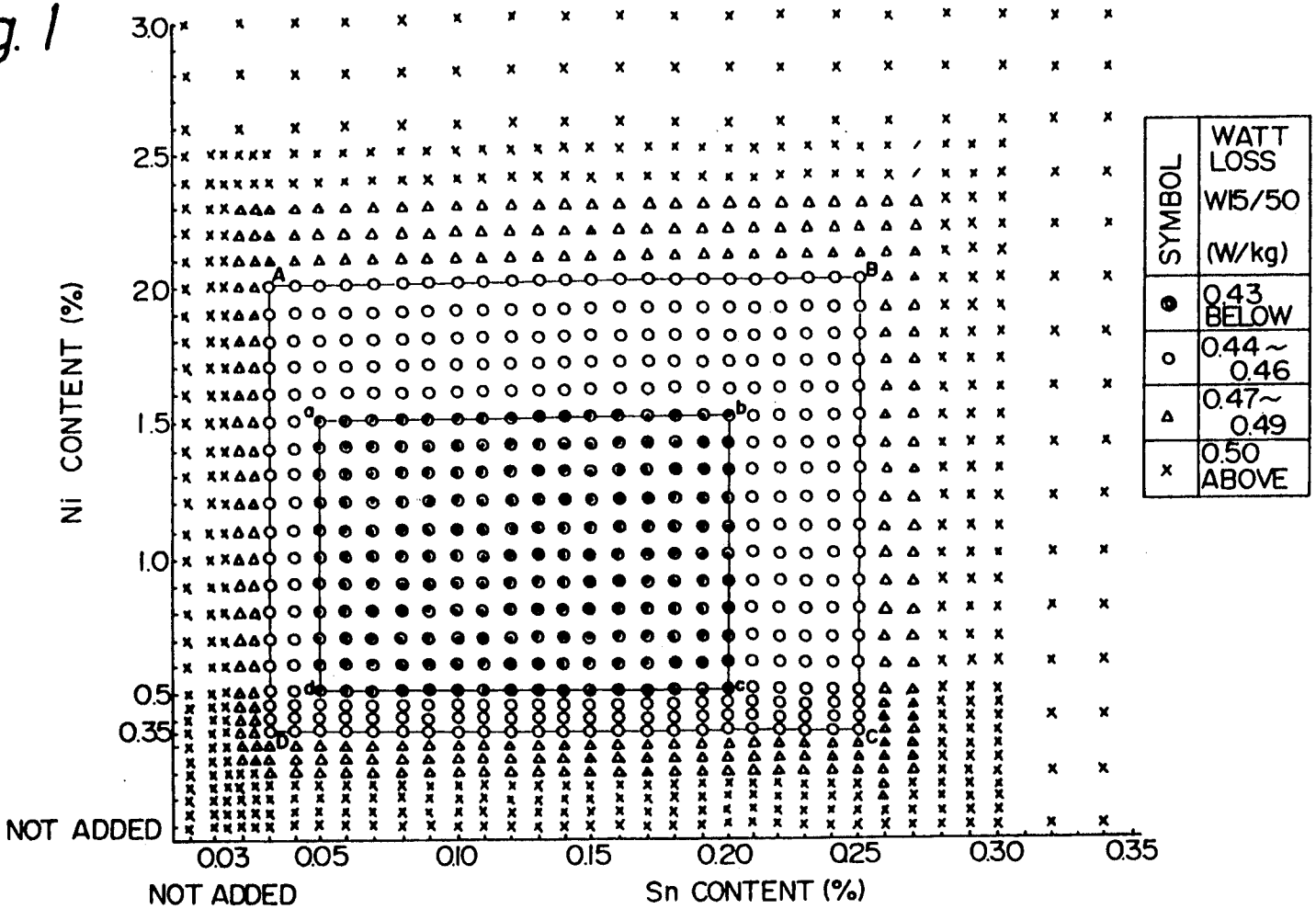
FIG. 1 is a diagram illustrating the relationship between the Sn and Ni contents and the watt loss in a grain-oriented electrical steel sheet which has a tension coating and which has been subjected to the magnetic domain-controlling treatment of the surface after the secondary recrystallization.

The present invention will now be described in detail.

EXPERIMENT I

Many slabs comprising 0.080% of C, 3.25% of Si, 0.075% of Mn, 0.0050% of P, 0.025% of S, 0.0250% of acid-soluble Al, 0.0085% of N, 0 or 0.01 to 0.34% of Sn, and 0 or 0.05 to 3.0% of Ni, with the balance being substantially Fe, were heated at 1350° C. for 60 minutes and hot-rolled to a thickness of 1.4 mm. Each hot-rolled sheet was annealed at 1100° C. for 120 seconds and cooled to normal temperature at a rate of 30° C./sec, and then the sheet was cold-rolled to a thickness of 0.170 mm. During the cold rolling, the maintaining of a temperature of 200° C. for 5 minutes was conducted 5 times. Then the decarburization annealing was carried out at 850° C. for 150 seconds in an atmosphere comprising 75% of $H_2$ and 25% of $N_2$ and having a dew point of 65° C.; the sheet was coated with an anneal separating agent composed mainly of magnesia and heated to 1200° C. at a rate of 20° C./hr in an atmosphere comprising 85% of $H_2$ and 15% of $N_2$; the sheet was soaked at 1200° C. for 20 hours in an $H_2$ atmosphere, and was cooled and the anneal separating agent was removed; and a tension coating was then formed and the surface of the steel sheet was irradiated with pulsative laser beams at an energy density of 2.0 J/cm$^2$, an irradiation width of 0.25 mm, and an irradiation interval of 5 mm in a direction orthogonal to the rolling direction. The flux density B8 (the flux density at a magnetizing force of 800 A/m) and the watt loss W15/50 were then measured, and the product sheet (except for the coating and glass) was analyzed. The relationships between the contents of Sn and Ni and the W15/50 of the product sheet are shown in FIG. 1.

In FIG. 1, the Sn content is plotted on the abscissa and the Ni content is plotted on the ordinate, and W15/50 is represented by symbols (◯, ◯, Δ and ×) It was found that, in the region surrounded by lines ABCD in FIG. 1, i.e., in the region where the Sn content is 0.03 to 0.25% and the Ni content is 0.35 to 2.0%, a superior watt loss characteristic is obtained. It also was found that, in the region surrounded by lines abcd, i.e., in the region where the Sn content is 0.05 to 0.20% and the Ni content is 0.50 to 1.5%, an especially superior watt loss characteristic is obtained. Note, the B8 was at least 1.88 T throughout the region surrounded by lines ABCD.

EXPERIMENT II

Many slabs comprising 0.082% of C, 3.25% of Si, 0.075% of Mn, 0.0050% of P, 0.025% of S, 0.0245% of acid-soluble Al, 0.0085% of N, 0.13% of Sn, 0.8% of Ni, and 0 or 0.01 to 0.20% of Cu, with the balance being substantially Fe, were heated at 1350° C. for 60 minutes and hot-rolled to a thickness of 1.4 mm, each hot-rolled sheet was annealed at 1120° C. for 90 seconds and cooled to normal temperature at a rate of 30° C./sec, and each sheet was then cold-rolled to a thickness of 0.170 mm. During the cold rolling, the maintaining of a temperature of 250° C. for 5 minutes was conducted 4 times. Then the decarburization annealing was carried out at 850° C. for 150 seconds in an atmosphere comprising 75% of $H_2$ and 25% of $N_2$ and having a dew point of 65° C.; an anneal separating agent composed mainly of magnesia was coated on the sheet and the sheet was heated to 1200° C. at a rate of 20° C./hr in an atmosphere comprising 85% of $H_2$ and 15% of $N_2$; the sheet was soaked at 1200° C. for 20 hours and then cooled, and the anneal separating agent was removed and a tension coating formed; and the surface of the steel sheet was irradiated with pulsative laser beams at an energy density of 2.0 J/cm$^2$, an irradiation width of 0.25 mm, and an irradiation interval of 5 mm in a direction orthogonal to the rolling direction. The flux density B8 (the flux density at a magnetizing force of 800 A/m) and the watt loss W15/50 were measured, and the product sheet (exclusive of the coating and glass) was analyzed. The relationship between the Cu content and the watt loss is shown in FIG. 2.

Figure 2:
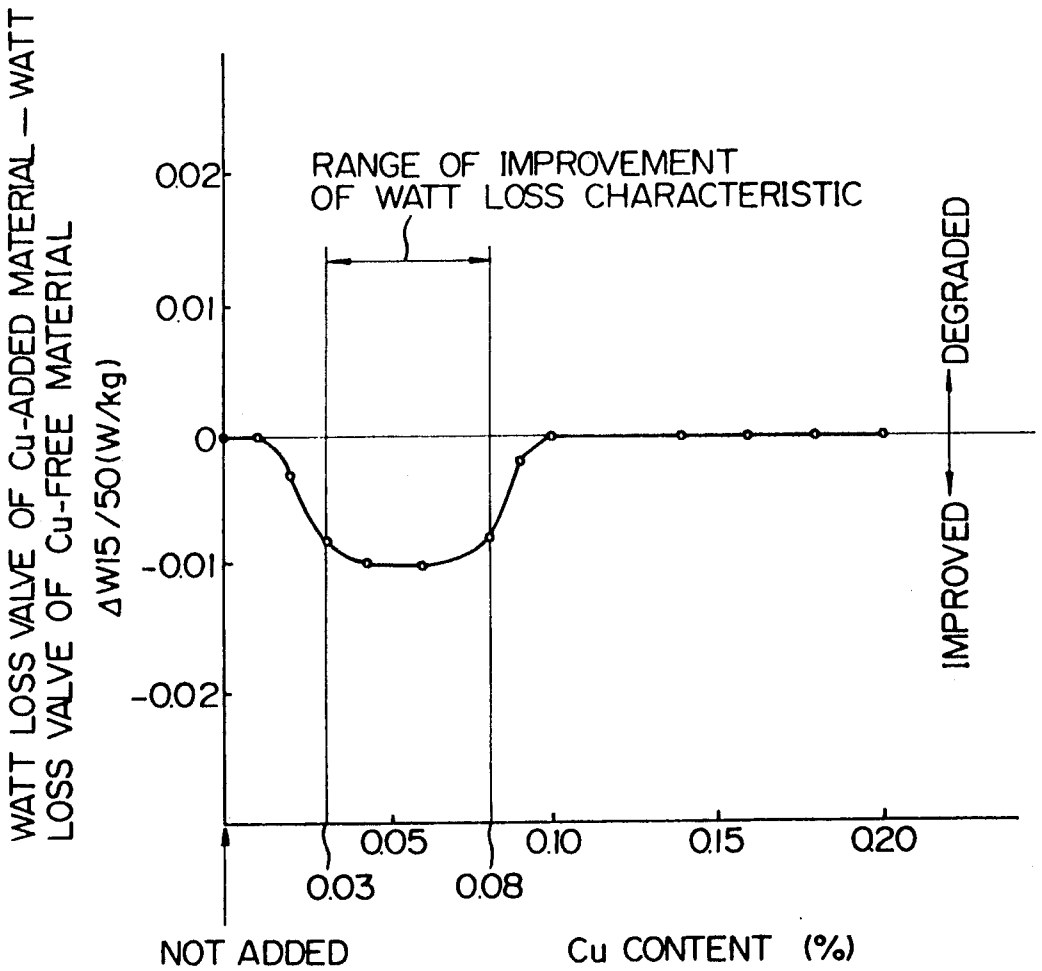
FIG. 2 is a diagram illustrating the dependency of the watt loss on the Cu content in a high-flux density, grain-oriented electrical steel sheet which contains predetermined amounts of Sn and Ni, has a tension coating, and has been subjected to the magnetic domain-controlling treatment of the surface after the secondary recrystallization.

In FIG. 2, the Cu content is plotted on the abscissa and the change of W15/50 due to an addition of Cu is plotted on the ordinate.

From the results shown in FIG. 2, it is seen that the watt loss characteristic is greatly improved if the Cu content is from 0.03 to 0.08%. Note, the B8 was at least 1.88 T throughout this range.

EXPERIMENT III

Figure 3:
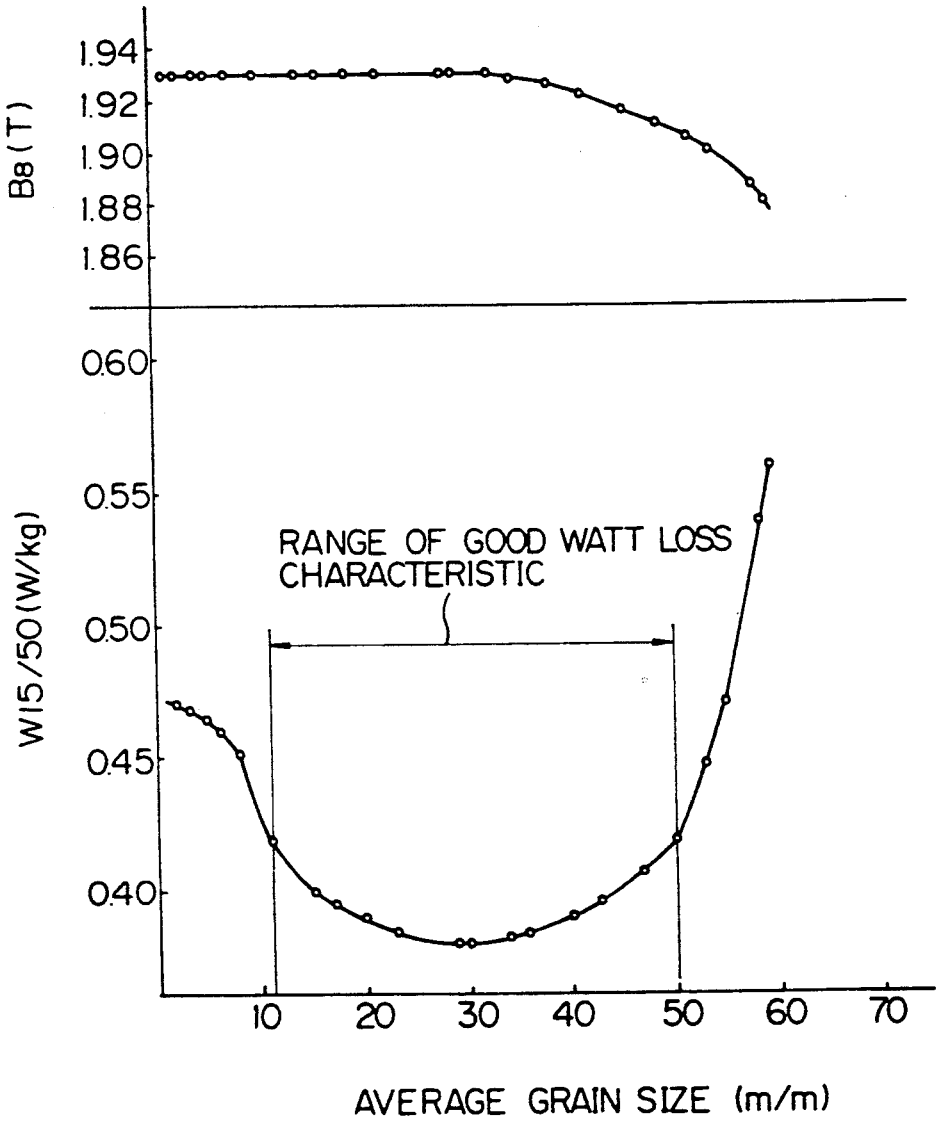
FIG. 3 is a diagram illustrating the relationship between the average grain size of crystal grains of the product and the flux density and watt loss in a grain-oriented electrical steel sheet formed by subjecting a material containing specific amounts of Sn and Ni to a high-temperature finish annealing when bent at a curvature radius of 400 mm, and to levelling annealing after the secondary recrystallization, which has a tension coating and has been subjected to the magnetic domain-controlling of the surface after the secondary recrystallization.

Many slabs comprising 0.080% of C, 3.23% of Si, 0.070% of Mn, 0.0030% of P, 0.025% of S, 0.0240% of acid-soluble Al, 0.0085% of N, 0.13% of Sn, and 0.7% of Ni, with the balance being substantially Fe, were heated at 1350° C. for 60 minutes and hot-rolled to a thickness of 0.80 to 2.80 mm. Each hot-rolled steel sheet was annealed at 1080° to 1140° C. for 90 seconds and cooled to normal temperature at a rate of 35° C./sec. Then the steel sheet was cold-rolled to a thickness of 0.170 mm, and during the cold rolling, maintaining of the temperature at 220° C. for 5 minutes was conducted 5 times; decarburization annealing was then carried out at 850° C. for 150 seconds in an atmosphere comprising 75% of $H_2$ and 25% of $N_2$ and having a dew point of 65° C., and an anneal separating agent composed mainly of magnesia was coated and the sheet was wound at a curvature radius of 400 mm; the wound sheet was heated to 1200° C. at a rate of 20° C./hr in an atmosphere comprising 85% of $H_2$ and 15% of $N_2$, and the sheet was soaked at 1200° C. for 20 hours in an atmosphere of $H_2$ and then cooled; the anneal separating agent was removed and a tension coating was formed, and the sheet was subjected to the levelling annealing; and the surface of the steel sheet was irradiated with pulsative laser beams at an energy density of 2.0 J/cm$^2$, an irradiation width of 0.25 mm, and an irradiation interval of 5 mm. The flux density B8 (the flux density at a magnetizing force of 800 A/m) and the watt loss W15/50 were measured. Then, the surface coating was removed, and the sizes of secondary recrystallization grains were measured in the rolled plane and in the rolling direction, the direction inclined at 45° from the rolling direction, and the direction inclined at 90° from the rolling direction by the line segment method, and the average grain size was determined (all of the average grain sizes referred to in the instant specification and appended claims are those determined by this method). The relationships between the average grain size and the B8 and W15/50 are shown in FIG. 3. In FIG. 3, the average grain size is plotted on the abscissa, and the B8 and W15/50 are plotted on the ordinate. As apparent from the results shown in FIG. 3, an especially superior watt loss characteristic was obtained if the average crystal grain size was from 11 to 50 mm.

From the results obtained in Experiments I through III, it can be understood that an especially superior watt loss characteristic is obtained in a high-flux density, grain-oriented electrical steel sheet having a flux density of at least 1.88 T at a magnetizing force of 800 A/m, in which the Sn and Ni contents are 0.03 to 0.25% and 0.35 to 2.0%, respectively, copper is preferably contained in an amount of 0.03 to 0.08%, the average grain size of the secondary recrystallization grains in the rolled plane is preferably 11 to 50 mm, a tension coating is formed, and the surface of the steel sheet after the secondary recrystallization is subjected to the artificial magnetic domain-controlling treatment in a direction substantially orthogonal to the rolling direction.

The present inventors made experiments similar to Experiments I through III described above with respect to the once-cold-rolling method and twice-cold-rolling method, in which at least one member selected from the group consisting of MnS, MnSe, $Cu_xS$, Sb and AlN was used as an inhibitor, and similar results were obtained.

EXPERIMENT IV

Many slabs comprising 0.030 to 0.150% if C, 3.25% of Si, 0.070% of Mn, 0.0035% of P, 0.026% of S, 0.0245% of acid-soluble Al, 0.0086% of N, 0.12% of Sn, and 0.7% of Ni, with the balance being substantially Fe, were heated at 1350° C. for 60 minutes and hot-rolled to a thickness of 2.3 or 1.4 mm, and each hot-rolled steel sheet was annealed at 1100° C. for 120 seconds and cooled to normal temperature at a rate of 35° C./sec. Then the sheets having a thickness of 2.3 mm were cold-rolled to 0.285 mm and the sheets having a thickness of 1.4 mm were cold-rolled to a thickness of 0.170 mm. During the cold rolling, maintaining the temperature at 230° C. for 5 minutes was conducted 5 times. Then, the decarburization annealing was carried out for 150 to 300 seconds at 850° C. in an atmosphere comprising 75% of $H_2$ and 25% of $N_2$ and having a dew point of 65° C.; an anneal separating agent composed mainly of magnesia was coated, and the steel sheet was heated to 1200° C. at a rate of 20° C./hr in an atmosphere comprising 85% of $H_2$ and 15% of $N_2$, soaked at 1200° C. for 20 hours in an atmosphere of $H_2$ and then cooled, and the anneal separating agent was removed and a tension coating was formed. Then, the surface of the steel sheet was irradiated with pulsating laser beams at an energy density of 2.0 J/cm$^2$, an irradiation width of 0.25 mm and an irradiation interval of 5 mm in a direction orthogonal to the rolling direction, and the flux density (the flux density at a magnetizing force of 800 A/m), the watt loss W15/50 and the watt loss W17/50 were measured to examine the state of the secondary recrystallization. The relationships between the C content in the slab and the secondary recrystallization ratio and the watt loss are shown in FIGS. 4 and 5.

Figure 4:
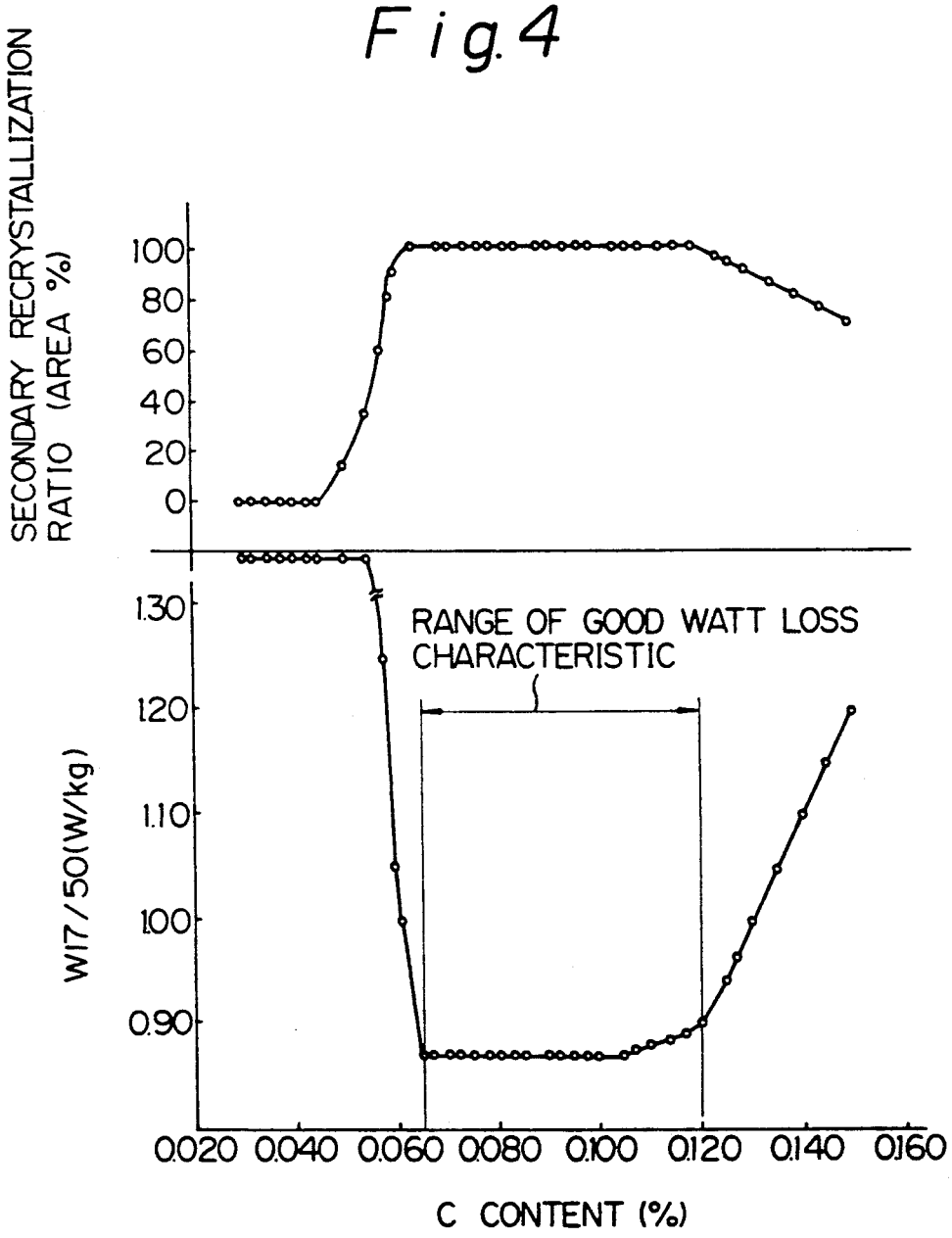
FIG. 4 is a diagram illustrating the relationships between the C content at the stage of the slab and the secondary recrystallization ratio of the product and the watt loss in a grain-oriented electrical steel sheet having a thickness of 0.285 mm, containing predetermined amounts of Sn and Ni and having a tension coating, which has been subjected to the magnetic domain-controlling treatment after the secondary recrystallization.

FIG. 4 shows the results obtained with respect to the sheet products having a thickness of 0.285 mm. In FIG. 4, the C content is plotted on the abscissa, and the secondary recrystallization ratio and W17/50 are plotted on the ordinate.

Figure 5:
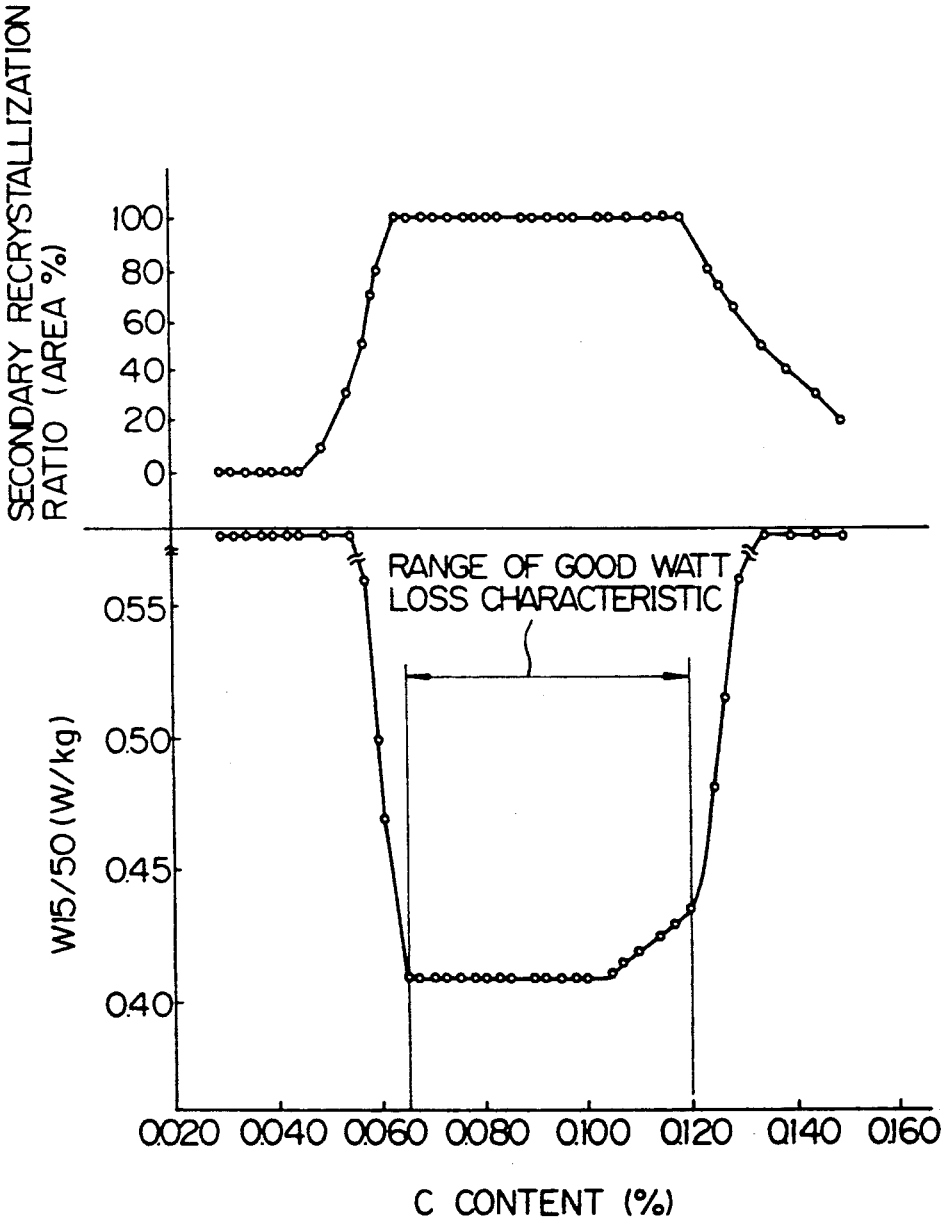
FIG. 5 is a diagram illustrating the relationships between the C content at the stage of the slab and the secondary recrystallization ratio of the product and the watt loss in a grain-oriented electrical steel sheet having a thickness of 0.170 mm, containing predetermined amounts of Sn and Ni and having a tension coating, which has been subjected to the magnetic domain-controlling treatment of the surface after the secondary recrystallization.

FIG. 5 shows the results obtained with respect to the sheet products having a thickness of 0.170 mm. In FIG. 5, the C content is plotted on the abscissa, and the secondary recrystallization ratio and W15/50 are plotted on the ordinate.

As apparent from the results shown in FIGS. 4 and 5, a superior watt loss was obtained if the C content was in the range of 0.065 to 0.120%. Note, the B8 was at least 1.88 T throughout this range.

EXPERIMENT V

Many slabs comprising 0.082% of C, 3.25% of Si, 0.072% of Mn, 0.0050% of P, 0.025% of S 0.0250% of acid-soluble Al, 0.0085% of N, 0.13% of Sn, 0.8% of Ni, and 0 or 0.001 to 0.050% of Sb, with the balance being substantially Fe, were heated at 1350° C. for 60 minutes and hot-rolled to a thickness of 1.4 mm, and each hot-rolled steel sheet was annealed at 1100° C. for 120 seconds, rapidly cooled to normal temperature, and cold-rolled to a thickness of 0.170 mm. During the cold rolling, maintaining the temperature at 250° C. for 5 minutes was conducted 5 times. Then the decarburization annealing was carried out at 850° C. for 150 seconds in an atmosphere comprising 75% of $H_2$ and 25% of $N_2$ and having a dew point of 65° C.; an anneal separating agent composed mainly of magnesia was coated and the steel sheet was heated to 1200° C. at a rate of 20° C./hr in an atmosphere comprising 85% of $H_2$ and 15% of $N_2$, and the sheet was soaked at 1200° C. for 20 hours in an atmosphere of $H_2$; the anneal separating agent was removed and a tension coating was formed; the surface of the steel sheet was irradiated with pulsating laser beams at an energy density of 2.0 J/cm$^2$, an irradiation width of 0.25 mm and an irradiation interval of 5 mm in a direction orthogonal to the rolling direction; and the flux density B8 (the flux density at a magnetizing force of 800 A/m) and the watt loss W15/50 were measured. The relationship between the Sb content in the slab and the watt loss is illustrated in FIG. 6.

Figure 6:
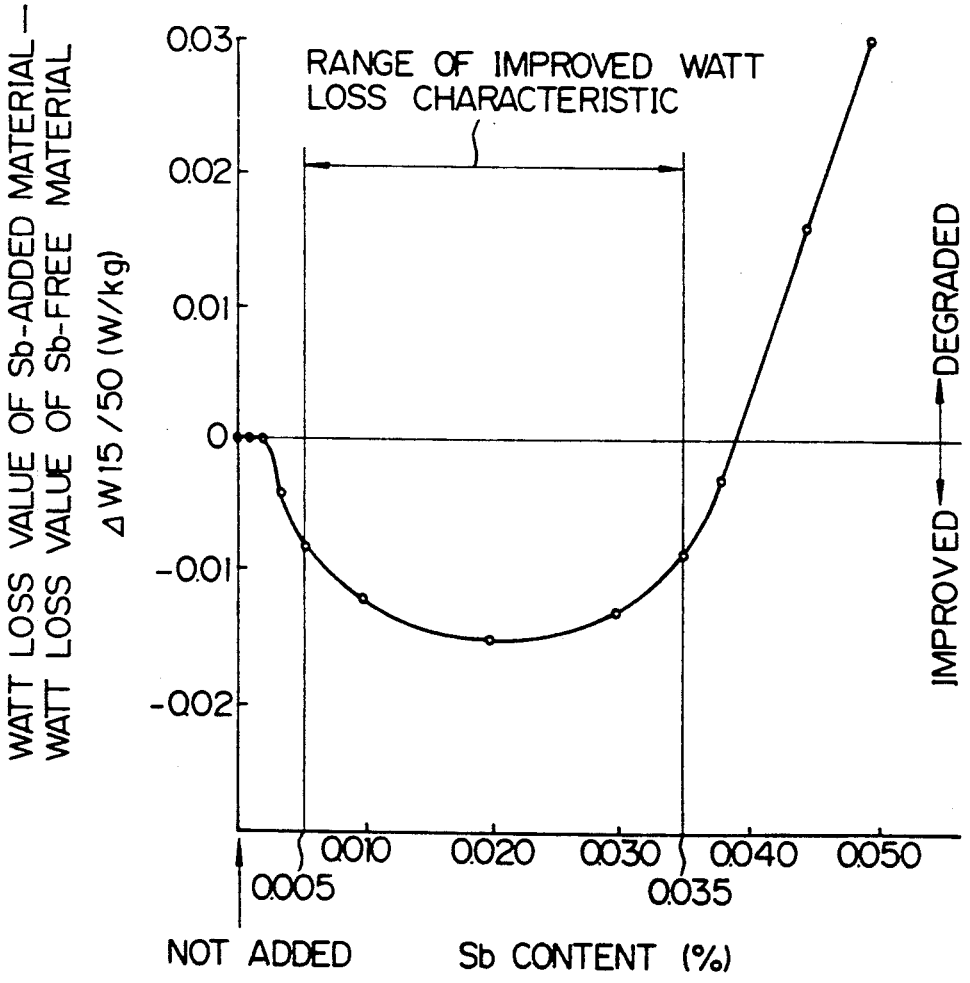
FIG. 6 is a diagram illustrating the dependency of the watt loss on the Sb content at the stage of the slab in a grain-oriented electrical steel sheet containing predetermined amounts of Sn and Ni and having a tension coating, which has been subjected to the magnetic domain-controlling treatment after the secondary recrystallization; and, FIG. 7 is a diagram illustrating the relationship between the slab-heating temperature and the flux density of the product in a grain-oriented electrical steel sheet containing predetermined amounts of Sn and Ni.

In FIG. 6, the Sb content is plotted on the abscissa and the change of W15/50 by addition of Sb is plotted on the ordinate.

As apparent from FIG. 6, the watt loss characteristic was improved if the Sb content was in the range of 0.005 to 0.035%. Note, the B8 was at least 1.88 T throughout this range.

From the results obtained in Experiments I through V, it can be understood that a high-flux density, grain-oriented electrical steel sheet having a flux density of at least 1.88 T and an especially superior watt loss characteristic can be obtained by a process of heating at 1320° to 1430° C. a slab comprising 0.065 to 0.120% of C, 2.8 to 4.5% of Si, 0.045 to 0.100% of Mn, 0.015 to 0.060% of at least one element selected from the group consisting of S and Se, 0.0150 to 0.0400% of acid-soluble Al, 0.0050 to 0.0100% of N, 0.03 to 0.25% of Sn, and 0.35 to 2.0% of Ni, with the balance consisting substantially of Fe and unavoidable impurities, hot-rolling the heated slab, annealing the hot-rolled steel sheet at 1030° to 1200° C. during a period of from the point of termination of the hot rolling to the point of initiation of the final cold rolling, subjecting the annealed steel sheet to a heat treatment for the rapid cooling, carrying out the final cold rolling at a thickness reduction ratio of 83 to 92%, carrying out the decarburization annealing in a wet atmosphere containing hydrogen, coating an anneal separating agent composed mainly of magnesia, winding the steel sheet in the form of a coil, carrying out the high-temperature finish annealing, removing the anneal separating agent, carrying out the levelling annealing, carrying out the tension coating before or after the levelling annealing, and subjecting the surface of the steel sheet to an artificial magnetic domain-controlling treatment in a direction orthogonal to the rolling direction after the secondary recrystallization and before or after the tension coating or levelling annealing.

The watt loss characteristic can be further improved if at least one member selected from the group consisting of 0.03 to 0.08% of Cu and 0.005 to 0.035% of Sb is incorporated as the constituent element in addition to the above-mentioned elements.

Also, the watt loss characteristic can be further improved if the average grain size in crystal grains of the product in the rolled plane is adjusted to 11 to 50 mm.

The reasons for the limitations other than those mentioned above will now be described.

The reasons for the limitations of the content of the components of the product sheet, other than the coating and glass, are described below.

Preferably, the C content is up to 0.0030%, as if the C content exceeds 0.0030%, the watt loss characteristic is degraded due to aging. Also preferably, the Si content is 2.8 to 4.5%, as if the Si content is lower then 2.8%, a good watt loss characteristic cannot be obtained, and if the Si content exceeds 4.5%, the processability is degraded. Further, preferably the Mn content is 0.045 to 0.100%, as if the Mn content is lower than 0.045% or higher than 0.100%, a good watt loss characteristic cannot be obtained, and preferably the content of at least one element selected from the group consisting of S and Se be up to 0.0050%, as if this content exceeds 0.0050%, a good watt loss characteristic cannot be obtained. Preferably the Al content is up to 0.0050%, as if the Al content exceeds 0.0050%, a good watt loss characteristic cannot be obtained, and preferably that the N content is up to 0.0030%, as if the N content exceeds 0.0030%, a good watt characteristic cannot be obtained.

Further preferably, a tension coating is present on the surface of the product steel sheet. The material of the tension coating is not particularly critical, but preferably a tension of at least 0.5 kg/mm$^2$ is imparted to the steel sheet by the tension coating, as if the tension coating is not formed, a good watt loss characteristic cannot be obtained.

Also preferably, the flux density at a magnetizing force of 800 A/m is at least 1.88 T, as if this flux density is lower than 1.88 T, a good watt characteristic cannot be obtained, and preferably the surface of the steel sheet after the secondary recrystallization is subjected to a magnetic domain-controlling treatment in a direction substantially orthogonal to the rolling direction, as if this magnetic domain-controlling treatment is not carried out, a good watt loss characteristic cannot be obtained.

The contents of elements in the slab will now be described. Note, all of "%" are by weight.

Preferably the Si content is 2.8 to 4.5%, as if the Si content is lower than 2.8%, a good watt characteristic cannot be obtained, and if the Si content exceeds 4.5%, the processability is degraded. Also preferably, the content of Mn is 0.045 to 0.100%, as if the Mn content is lower than 0.045% or higher than 0.100%, a good watt characteristic cannot be obtained, and preferably, the content of at least one element selected from the group consisting of S and Se is 0.015 to 0.060%, as if this content is lower than 0.015% or higher than 0.060%, a good watt loss characteristic cannot be obtained. Further preferably, the content of acid-soluble Al is 0.0150 to 0.0400%, as if the acid-soluble Al content is lower than 0.0150%, a good watt loss characteristic cannot be obtained, and if the acid-soluble Al content is higher than 0.0400%, the secondary recrystallization becomes unstable, and preferably, the N content is 0.0050 to 0.0100%, as if the N content is lower than 0.0050%, the secondary recrystallization becomes unstable, and if the N content is higher than 0.0100%, a blister flaw is formed.

Preferably, the slab-heating temperature is 1320° to 1430° C., as if the slab-heating temperature is lower than 1320° C., the solid dissolution of a sulfide and a nitride is unsatisfactory and a good inhibitor is not formed, with the result that the secondary recrystallization becomes unstable. If the slab-heating temperature is higher than 1430° C., edge cracking becomes conspicuous in the hot-rolled steel sheet.

Preferably, annealing is carried out at 1030° to 1200° C. and rapid cooling be carried out after the annealing during a period of from the point of completion of the hot rolling to the point of initiation of the final cold rolling. If the annealing temperature is lower than 1030° C., a good watt characteristic cannot be obtained, and if the annealing temperature is higher than 1200° C., the secondary recrystallization becomes unstable. The rapid cooling after the annealing is important for obtaining a product having good magnetic characteristics.

Also preferably, the thickness reduction ratio at the final cold rolling is 83 to 92%, as if this thickness reduction ratio is lower than 83% or higher than 92%, a good watt characteristic cannot be obtained, and preferably, that maintaining at a temperature of 150° to 300° C. for at least 30 seconds is conducted during the final cold rolling. Nevertheless, even if this high temperature maintaining is not carried out during the rolling, the effect of the present invention will still be obtained.

The high-temperature finish annealing must be carried out at a high temperature for a long time, and preferably, after the decarburization annealing, an anneal separating agent is coated, the sheet is wound in the form of a coil, and annealing is carried out while placing the coil in an up end. In this case, the curvature radius of the inner circumference of the coil is preferably about 250 to about 400 mm. If the curvature radius is smaller than 250 mm, deformation of the sheet at the winding step and degradation of the watt loss characteristic at the levelling annealing after the secondary recrystallization may occur, and if the curvature radius exceeds 400 mm, the equipment cost is increased.

Preferably, the tension coating is carried out before or after the levelling annealing, as if the tension coating is not carried out, a good watt loss characteristic cannot be obtained.

Also preferably, the surface of the steel sheet is subjected to an artificial magnetic domain-controlling treatment in a direction substantially orthogonal to the rolling direction after the secondary recrystallization and before or after the tension coating or the levelling annealing.

From the economical viewpoint, preferably the baking of the tension coating is effected simultaneously with the levelling annealing. Of course, the levelling annealing and the baking of the tension coating can be carried out separately, and a method can be adopted in which the tension coating is carried out after the levelling annealing. The magnetic domain-controlling treatment can be carried out between the levelling annealing and the tension coating. If the magnetic domain-controlling treatment is not carried out, a good watt characteristic cannot be obtained. Known methods already disclosed can be adopted for the magnetic domain-controlling treatment. As such a known method, a method can be adopted in which the surface is irradiated with laser beams at predetermined intervals, as disclosed in Japanese Unexamined Patent Publication No. 55-18566 and Japanese Unexamined Patent Publication No. 58-73724, a method in which intrusions are formed at predetermined intervals, as disclosed in Japanese Unexamined Patent Publication No. 61-96036, a method in which grooves are formed at predetermined intervals, as disclosed in Japanese Unexamined Patent Publication No. 61-117218, a method in which a part of the base steel is removed at predetermined intervals and a phosphate-type tension coating is formed on the surface, as disclosed in Japanese Unexamined Patent Publication No. 61-117284, and a method in which the surface is brought into contact with a plasma flame at predetermined intervals, as disclosed in Japanese Unexamined Patent Publication No. 62-151511.

The crystal grain size of the product in the rolled plane can be adjusted by controlling the ingredients of the starting material, the annealing conditions, the final cold-rolling conditions or the composition of the anneal separating agent, and any adjustment method can be adopted.

The reasons why the watt loss characteristic is greatly improved if specific amounts of Sn and Ni are incorporated and the surface of a high-flux density, grain-oriented electrical sheet having a tension coating is subjected to a magnetic domain-controlling treatment in a direction substantially orthogonal to the rolling direction have not been completely elucidated, but it is believed that, if Sn and Ni are incorporated in combination, the base steel, the interface between the base steel and glass or the glass will probably be changed to exert a function of minimizing the watt loss of the steel sheet which has been subjected to the magnetic domain-controlling treatment.

The reason why a superior watt loss characteristic is obtained if the average grain size of crystal grains of the product in the rolled plane is adjusted to 11 to 50 mm is believed to be as follows. If the average grain size is smaller than 11 mm, in the case of the steel sheet of the present invention which has been subjected to the magnetic domain-controlling treatment, it is believed that fine grain boundaries are detrimental to a magnetic domain-forming pattern minimizing the watt loss. Where the steel sheet in the bent state is subjected to high-temperature annealing, if the average grain size exceeds 50 mm, the watt loss characteristic is degraded. It is considered that this degradation is due to the dislocation of the Goss's orientation from the rolled plane by the levelling annealing after the high-temperature finish annealing.

The present invention will now be described in detail with reference to the following examples.

EXAMPLE 1

Slabs comprising 0.050, 0.083 or 0.150% of C, 3.25% of Si, 0.070% of Mn, 0.0040% of P, 0, 0.015 or 0.025% of S, 0, 0.015 or 0.025% of Se, 0.0245% of acid-soluble Al, 0.0085% of N, 0, 0.05, 0.7 or 2.5% of Ni, 0, 0.06 or 0.20% of Cu and 0, 0.020 or 0.050% Sb, with the balance consisting of Fe and unavoidable impurities, were heated at 1350° C. for 60 minutes and hot-rolled to a thickness of 0.90 to 3.25 mm.

The hot-rolled sheets were treated to the final cold rolling step according to the following process I, II or III.

In the process I, the hot-rolled steel sheet was annealed at a temperature of 1000° to 1220° C. for 90 seconds, the annealed steel sheet was cooled to normal temperature at a rate of 35° C./sec, and the final cold rolling was carried out.

In the process II, the hot-rolled steel sheet was annealed at a temperature of 1000° to 1220° C. for 90 seconds, cooled to normal temperature at a rate of 35° C./sec, the annealed steel sheet subjected to the intermediate cold rolling to a certain intermediate thickness, and then to the intermediate annealing at 1000° C. for 100 seconds, and the steel sheet was then cooled to normal temperature at a rate of 35° C./sec, after which the final cold rolling was carried out.

In the process III, the hot-rolled steel sheet was annealed at 1000° C. for 100 seconds, the annealed steel sheet was cooled to normal temperature at a rate of 35° C./sec, the intermediate cold rolling was carried out to a certain intermediate thickness, the steel sheet was annealed at a temperature of 1000° to 1220° C. for 90 seconds and the annealed steel sheet was cooled to normal temperature at a rate of 35° C./sec, and the final cold rolling was carried out.

During the final cold rolling, the maintaining of the temperature at 250° C. for 5 minutes was conducted 5 times, or this high temperature maintaining was not conducted.

After the final cold rolling, the decarburization annealing was carried out at 850° C. for 150 to 300 seconds in a wet atmosphere comprising 75% of $H_2$ and 25% of $N_2$, and an anneal separating agent composed mainly of magnesia was coated on the steel sheet, the steel sheet was then wound in the form of a coil having a curvature radius of 400 mm and the high-temperature finish annealing was carried out. At the high-temperature finish annealing, in an atmosphere comprising 85% or $H_2$ and 15% of $N_2$, the temperature was elevated to 1200° C. at a rate of 25° C./hr, and then the steel sheet was annealed at 1200° C. for 20 hours in a hydrogen atmosphere. Then, the anneal separating agent was removed, and according to the following method A, B, C or D, the magnetic domain-controlling treatment, the tension coating, and the annealing were carried out.

In the method A, the tension coating was carried out so that the tension given to the steel sheet was 1.0 kg/mm$^2$ per unit sectional area, and the levelling annealing as well as the baking of the coating was carried out at 850° C. for 30 seconds. Then the surface of the steel sheet was irradiated with pulsating laser beams at an energy density of 2.0 J/cm$^2$, an irradiation width of 0.25 mm, and an irradiation interval of 5 mm in a direction orthogonal to the rolling direction.

In the method B, after the treatment of the method A, a powder of metallic Sb was coated on the steel sheet and the annealing was carried out at 800° C. for 2 hours.

In the method C, the surface of the steel sheet was irradiated with pulsating laser beams at an energy density of 3.0 J/cm$^2$, an irradiation width of 0.2 mm, and an irradiation interval of 5 mm in a direction orthogonal to the rolling direction to locally remove the forsterite layer. and the steel sheet was dipped in a 61% aqueous solution of nitric acid for 20 seconds and a tension coating was formed so that the tension per unit sectional area of the steel sheet was 1.0 kg/mm$^2$. Then the levelling annealing as well as the baking of the coating was carried out at 850° C. for 30 seconds.

In the method D, the strain was introduced under a load of 180 kg/mm$^2$ by using a gear roll in which the gear pitch was 8 mm, the curvature radius of the gear tip was 100 μm, and the inclination angle of the gear cog was 75° to the rolling direction, and the tension coating was carried out so that the tension per unit sectional area of the steel sheet was 1.0 kg/mm$^2$. The levelling annealing as well as the baking of the coating was carried out at 850° C. for 30 seconds.

After the treatment according to the method A, B, C or D, the flux density B8 and watt loss were measured, the surface coating was then removed. the steel sheet was pickled, and the average grain size of the secondary recrystallization grains in the rolled plane were measured. The product sheet (other than the coating and glass) was analyzed. The composition of the slab, the composition of the product sheet, the thickness of the hot-rolled steel sheet, the preparation process (I, II or III), the temperature for annealing the hot-rolled steel sheet, the thickness after the intermediate cold rolling, the intermediate annealing temperature, the thickness after the final cold rolling, the thickness reduction ratio at the final cold rolling, the presence or absence of the high temperature maintaining during the final cold rolling, the presence or absence of the tension coating, the average grain size of crystal grains in the product, the magnetic domain-controlling method (A, B, C or D), the flux density B8 and the watt loss are all shown in Table 1.

As apparent from the results shown in Table 1, according to the present invention, high-flux density, grain-oriented electrical steel sheets having a superior watt loss characteristics were obtained.

TABLE 1

| Run | Composition (%) of Slab | | | | | | | Composition (%) of Product Sheet | | | Thickness of Hot-Rolled Steel Sheet | Preparation | Temperature for Annealing Hot-Rolled Sheet | Thickness after Intermediate Cold Rolling |
|---|---|---|---|---|---|---|---|---|---|---|---|---|---|---|
| No | C | S | Se | Sn | Ni | Cu | Sb | Sn | Ni | Cu | (m/m) | Process | (°C.) | (m/m) |
| 1 | 0.083 | 0.025 | not added | 0.15 | 0.7 | not added | not added | 0.15 | 0.7 | 0.001 | 1.40 | I | 1100 | / |
| 2 | 0.083 | 0.025 | " | x not added | 0.7 | " | " | x 0.001 | 0.7 | 0.001 | 1.40 | I | 1100 | " |
| 3 | 0.083 | 0.025 | " | x 0.01 | 0.7 | " | " | x 0.01 | 0.7 | 0.001 | 1.40 | I | 1100 | " |
| 4 | 0.083 | 0.025 | " | x 0.30 | 0.7 | " | " | x 0.30 | 0.7 | 0.001 | 1.40 | I | 1100 | " |
| 5 | 0.083 | 0.025 | " | 0.15 | x not added | " | " | 0.15 | x 0.01 | 0.001 | 1.40 | I | 1100 | " |
| 6 | 0.083 | 0.025 | " | 0.15 | x 0.05 | " | " | 0.15 | x 0.05 | 0.001 | 1.40 | I | 1100 | " |
| 7 | 0.083 | 0.025 | " | 0.15 | x 2.5 | " | " | 0.15 | x 2.5 | 0.001 | 1.40 | I | 1100 | " |
| 8 | 0.083 | 0.025 | " | x 0.30 | x 2.5 | " | " | x 0.30 | x 2.5 | 0.001 | 1.40 | I | 1100 | " |
| 9 | 0.083 | 0.025 | " | 0.15 | 0.7 | 0.06 | " | 0.15 | 0.7 | 0.06 | 1.40 | I | 1100 | " |
| 10 | 0.083 | 0.025 | " | 0.15 | 0.7 | x 0.20 | " | 0.15 | 0.7 | x 0.20 | 1.40 | I | 1100 | " |
| 11 | 0.083 | 0.025 | " | 0.15 | 0.7 | not added | " | 0.15 | 0.7 | 0.001 | 1.40 | I | 1100 | " |
| 12 | 0.083 | 0.025 | " | 0.15 | 0.7 | " | " | 0.15 | 0.7 | 0.001 | 0.90 | I | 1100 | " |
| 13 | 0.083 | 0.025 | " | 0.15 | 0.7 | " | " | 0.15 | 0.7 | 0.001 | 1.60 | I | 1100 | " |
| 14 | 0.083 | 0.025 | " | 0.15 | 0.7 | " | " | 0.15 | 0.7 | 0.001 | 2.50 | I | 1100 | " |
| 15 | 0.083 | 0.025 | " | 0.15 | 0.7 | " | " | 0.15 | 0.7 | 0.001 | 1.40 | I | 1100 | " |
| 16 | 0.083 | 0.025 | " | 0.15 | 0.7 | " | " | 0.15 | 0.7 | 0.001 | 1.40 | I | 1100 | " |
| 17 | 0.083 | 0.025 | " | 0.15 | 0.7 | " | " | 0.15 | 0.7 | 0.001 | 1.40 | I | 1100 | " |
| 18 | 0.083 | 0.015 | 0.015 | 0.15 | 0.7 | " | " | 0.15 | 0.7 | 0.001 | 1.40 | I | 1100 | " |
| 19 | 0.083 | 0.015 | 0.015 | x not added | 0.7 | " | " | x 0.001 | 0.7 | 0.001 | 1.40 | I | 1100 | " |
| 20 | 0.083 | 0.015 | 0.015 | x 0.30 | 0.7 | " | " | x 0.30 | 0.7 | 0.001 | 1.40 | I | 1100 | " |
| 21 | 0.083 | 0.015 | 0.015 | 0.15 | x not added | " | " | 0.15 | x 0.01 | 0.001 | 1.40 | I | 1100 | " |
| 22 | 0.083 | 0.015 | 0.015 | 0.15 | x 2.5 | " | " | 0.15 | x 2.5 | 0.001 | 1.40 | I | 1100 | " |
| 23 | 0.083 | 0.015 | 0.015 | 0.15 | 0.7 | 0.06 | " | 0.15 | 0.7 | 0.06 | 1.40 | I | 1100 | " |
| 24 | 0.083 | not added | 0.025 | 0.15 | 0.7 | not added | " | 0.15 | 0.7 | 0.001 | 1.40 | I | 1100 | " |
| 25 | 0.083 | " | 0.025 | x not added | 0.7 | " | " | x 0.001 | 0.7 | 0.001 | 1.40 | I | 1100 | " |
| 26 | 0.083 | " | 0.025 | x 0.30 | 0 7 | " | " | x 0.30 | 0.7 | 0.001 | 1.40 | I | 1100 | " |
| 27 | 0.083 | " | 0.025 | 0.15 | x not added | " | " | 0.15 | x 0.01 | 0.001 | 1.40 | I | 1100 | " |
| 28 | 0.083 | " | 0.025 | 0.15 | x 2.5 | " | " | 0.15 | x 2.5 | 0.001 | 1.40 | I | 1100 | " |
| 29 | 0.083 | " | 0.025 | 0.15 | 0.7 | 0.06 | " | 0.15 | 0.7 | 0.06 | 1.40 | I | 1100 | " |

TABLE 1-continued

| | | | | | | | | | | | | | | |
|---|---|---|---|---|---|---|---|---|---|---|---|---|---|---|
| 30 | 0.083 | 0.025 | not added | 0.15 | 0.7 | not added | " | 0.15 | 0.7 | 0.001 | 2.30 | I | 1100 | " |
| 31 | 0.083 | 0.025 | " | x not added | 0.7 | " | " | x 0.001 | 0.7 | 0.001 | 2.30 | I | 1100 | " |
| 32 | 0.083 | 0.025 | " | x 0.30 | 0.7 | " | " | x 0.30 | 0.7 | 0.001 | 2.30 | I | 1100 | " |
| 33 | 0.083 | 0.025 | " | 0.15 | x not added | " | " | 0.15 | x 0.01 | 0.001 | 2.30 | I | 1100 | " |
| 34 | 0.083 | 0.025 | " | 0.15 | x 2.5 | " | " | 0.15 | x 2.5 | 0.001 | 2.30 | I | 1100 | " |
| 35 | 0.083 | 0.015 | 0.015 | 0.15 | 0.7 | 0.06 | " | 0.15 | 0.7 | 0.06 | 1.30 | I | 1100 | " |
| 36 | 0.083 | 0.015 | 0.015 | x not added | 0.7 | 0.06 | " | x 0.001 | 0.7 | 0.06 | 1.30 | I | 1100 | " |
| 37 | 0.083 | 0.015 | 0.015 | x 0.30 | 0.7 | 0.06 | " | x 0.30 | 0.7 | 0.06 | 1.30 | I | 1100 | " |
| 38 | 0.083 | 0.015 | 0.015 | 0.15 | x not added | 0.06 | " | 0.15 | x 0.01 | 0.06 | 1.30 | I | 1100 | " |
| 39 | 0.083 | 0.015 | 0.015 | 0.15 | x 2.5 | 0.06 | " | 0.15 | x 2.5 | 0.06 | 1.30 | I | 1100 | " |
| 40 | 0.083 | 0.015 | 0.015 | 0.15 | 0.7 | not added | " | 0.15 | 0.7 | 0.001 | 2.00 | II | 1100 | 1.30 |
| 41 | 0.083 | 0.015 | 0.015 | x not added | 0.7 | " | " | x 0.001 | 0.7 | 0.001 | 2.00 | II | 1100 | 1.30 |
| 42 | 0.083 | 0.015 | 0.015 | x 0.30 | 0.7 | " | " | x 0.30 | 0.7 | 0.001 | 2.00 | II | 1100 | 1.30 |
| 43 | 0.083 | 0.015 | 0.015 | 0.15 | 0.7 | 0.06 | " | 0.15 | 0.7 | 0.06 | 2.00 | II | 1100 | 1.30 |
| 44 | 0.083 | 0.015 | 0.105 | 0.15 | x not added | 0.06 | " | 0.15 | x 0.01 | 0.06 | 2.00 | II | 1100 | 1.30 |
| 45 | 0.083 | 0.015 | 0.015 | 0.15 | x 2.5 | 0.06 | " | 0.15 | x 2.5 | 0.06 | 2.00 | II | 1100 | 1.30 |
| 46 | 0.083 | 0.015 | 0.015 | 0.15 | 0.7 | 0.06 | " | 0.15 | 0.7 | 0.06 | 1.30 | II | 1100 | 0.77 |
| 47 | 0.083 | 0.015 | 0.015 | x not added | 0.7 | 0.06 | " | x 0.001 | 0.7 | 0.06 | 1.30 | II | 1100 | 0.77 |
| 48 | 0.083 | 0.015 | 0.015 | x 0.30 | 0.7 | 0.06 | " | x 0.30 | 0.7 | 0.06 | 1.30 | II | 1100 | 0.77 |
| 49 | 0.083 | 0.015 | 0.015 | 0.15 | x not added | 0.06 | " | 0.15 | x 0.01 | 0.06 | 1.30 | II | 1100 | 0.77 |
| 50 | 0.083 | 0.015 | 0.015 | 0.15 | x 2.5 | 0.06 | " | 0.15 | x 2.5 | 0.06 | 1.30 | II | 1100 | 0.77 |
| 51 | 0.083 | 0.015 | 0.015 | 0.15 | 0.7 | 0.06 | " | 0.15 | 0.7 | 0.06 | 2.00 | III | 1000 | 1.30 |
| 52 | 0.083 | 0.015 | 0.015 | x not added | 0.7 | 0.06 | " | x 0.001 | 0.7 | 0.06 | 2.00 | III | 1000 | 1.30 |
| 53 | 0.083 | 0.015 | 0.015 | x 0.30 | 0.7 | 0.06 | " | x 0.30 | 0.7 | 0.06 | 2.00 | III | 1000 | 1.30 |
| 54 | 0.083 | 0.015 | 0.105 | 0.15 | 0.7 | not added | " | 0.15 | 0.7 | 0.001 | 2.00 | III | 1000 | 1.30 |
| 55 | 0.083 | 0.015 | 0.015 | 0.15 | x not added | not added | " | 0.15 | x 0.01 | 0.001 | 2.00 | III | 1000 | 1.30 |
| 56 | 0.083 | 0.015 | 0.015 | 0.15 | x 2.5 | " | " | 0.15 | x 2.5 | 0.001 | 2.00 | III | 1000 | 1.30 |
| 57 | 0.083 | 0.015 | 0.015 | 0.15 | 0.7 | 0.06 | " | 0.15 | 0.7 | 0.06 | 1.30 | III | 1100 | 0.77 |
| 58 | 0.083 | 0.015 | 0.015 | x not added | 0.7 | 0.06 | " | x 0.001 | 0.7 | 0.06 | 1.30 | III | 1000 | 0.77 |
| 59 | 0.083 | 0.015 | 0.015 | x 0.30 | 0.7 | 0.06 | " | x 0.30 | 0.7 | 0.06 | 1.30 | III | 1000 | 0.77 |
| 60 | 0.083 | 0.015 | 0.015 | 0.15 | x not added | 0.06 | " | 0.15 | x 0.01 | 0.06 | 1.30 | III | 1000 | 0.77 |
| 61 | 0.083 | 0.015 | 0.015 | 0.15 | x 2.5 | 0.06 | " | 0.15 | x 2.5 | 0.06 | 1.30 | III | 1000 | 0.77 |
| 62 | x 0.050 | 0.025 | not added | 0.15 | 0.7 | not added | " | 0.15 | 0.7 | 0.001 | 1.40 | I | 1100 | / |
| 63 | x 0.150 | 0.025 | " | 0.15 | 0.7 | " | " | 0.15 | 0.7 | 0.001 | 1.40 | I | 1100 | " |
| 64 | x 0.050 | 0.015 | 0.015 | 0.15 | 0.7 | " | " | 0.15 | 0.7 | 0.001 | 1.40 | I | 1100 | " |
| 65 | x 0.150 | 0.015 | 0.015 | 0.15 | 0.7 | " | " | 0.15 | 0.7 | 0.001 | 1.40 | I | 1100 | " |
| 66 | x 0.050 | not added | 0.025 | 0.15 | 0.7 | " | " | 0.15 | 0.7 | 0.001 | 1.40 | I | 1100 | " |
| 67 | x 0.150 | " | 0.025 | 0.15 | 0.7 | " | " | 0.15 | 0.7 | 0.001 | 1.40 | I | 1100 | " |
| 68 | x 0.050 | 0.015 | 0.015 | 0.15 | 0.7 | 0.06 | " | 0.15 | 0.7 | 0.06 | 2.00 | II | 1100 | 1.30 |
| 69 | x 0.150 | 0.015 | 0.015 | 0.15 | 0.7 | 0.06 | " | 0.15 | 0.7 | 0.06 | 2.00 | II | 1100 | 1.30 |
| 70 | x 0.050 | 0.015 | 0.015 | 0.15 | 0.7 | 0.06 | " | 0.15 | 0.7 | 0.06 | 2.00 | III | 1000 | 1.30 |
| 71 | x 0.150 | 0.015 | 0.015 | 0.15 | 0.7 | 0.06 | " | 0.15 | 0.7 | 0.06 | 2.00 | III | 1000 | 1.30 |
| 72 | 0.830 | 0.025 | not added | 0.15 | 0.7 | not added | 0.020 | 0.15 | 0.7 | 0.001 | 1.40 | I | 1100 | / |
| 73 | 0.083 | 0.025 | " | 0.15 | 0.7 | " | x | 0.15 | 0.7 | 0.001 | 1.40 | I | 1100 | " |

TABLE 1-continued

| | | | | | | | | | | | | | | |
|---|---|---|---|---|---|---|---|---|---|---|---|---|---|---|
| | | | | | | | 0.050 | | | | | | | |
| 74 | 0.083 | 0.025 | " | 0.15 | 0.7 | 0.06 | 0.020 | 0.15 | 0.7 | 0.06 | 1.40 | I | 1100 | " |
| 75 | 0.083 | 0.015 | 0.015 | 0.15 | 0.7 | not added | 0.020 | 0.15 | 0.7 | 0.001 | 1.40 | I | 1100 | " |
| 76 | 0.083 | 0.015 | 0.015 | 0.15 | 0.7 | " | x 0.050 | 0.15 | 0.7 | 0.001 | 1.40 | I | 1100 | " |
| 77 | 0.083 | 0.015 | 0.015 | 0.15 | 0.7 | 0.06 | 0.020 | 0.15 | 0.7 | 0.06 | 1.40 | I | 1100 | " |
| 78 | 0.083 | 0.015 | 0.015 | 0.15 | 0.7 | not added | not added | 0.15 | 0.7 | 0.001 | 1.40 | I | x 1100 | " |
| 79 | 0.083 | 0.015 | 0.015 | 0.15 | 0.7 | " | " | 0.15 | 0.7 | 0.001 | 1.40 | I | x 1220 | " |
| 80 | 0.083 | 0.015 | 0.015 | 0.15 | 0.7 | " | " | 0.15 | 0.7 | 0.001 | 2.00 | II | x 1000 | 1.30 |
| 81 | 0.083 | 0.015 | 0.015 | 0.15 | 0.7 | " | " | 0.15 | 0.7 | 0.001 | 2.00 | II | x 1220 | 1.30 |
| 82 | 0.083 | 0.015 | 0.015 | 0.15 | 0.7 | " | " | 0.15 | 0.7 | 0.001 | 2.00 | III | 1000 | 1.30 |
| 83 | 0.083 | 0.015 | 0.015 | 0.15 | 0.7 | " | " | 0.15 | 0.7 | 0.001 | 2.00 | III | 1000 | 1.30 |
| 84 | 0.083 | 0.015 | 0.015 | 0.15 | 0.7 | 0.06 | " | 0.15 | 0.7 | 0.06 | 1.20 | II | 1120 | 0.76 |
| 85 | 0.083 | 0.015 | 0.015 | 0.15 | 0.7 | 0.06 | " | 0.15 | 0.7 | 0.06 | 1.85 | II | 1120 | 1.20 |
| 86 | 0.083 | 0.015 | 0.015 | 0.15 | 0.7 | 0.06 | " | 0.15 | 0.7 | 0.06 | 3.25 | II | 1120 | 2.10 |
| 87 | 0.083 | 0.015 | 0.015 | 0.15 | 0.7 | 0.06 | " | 0.15 | 0.7 | 0.06 | 1.20 | III | 1000 | 0.76 |
| 88 | 0.083 | 0.015 | 0.015 | 0.15 | 0.7 | 0.06 | " | 0.15 | 0.7 | 0.06 | 1.85 | III | 1000 | 1.20 |
| 89 | 0.083 | 0.015 | 0.015 | 0.15 | 0.7 | 0.06 | " | 0.15 | 0.7 | 0.06 | 3.25 | III | 1000 | 2.10 |
| 90 | 0.083 | 0.025 | not added | 0.15 | 0.7 | not added | " | 0.15 | 0.7 | 0.001 | 2.30 | I | 1120 | / |
| 91 | 0.083 | 0.025 | " | x not added | 0.7 | " | " | x 0.001 | 0.7 | 0.001 | 2.30 | I | 1120 | " |
| 92 | 0.083 | 0.025 | " | x 0.30 | 0.7 | " | " | x 0.30 | 0.7 | 0.001 | 2.30 | I | 1120 | " |
| 93 | 0.083 | 0.025 | " | 0.15 | x not added | " | " | 0.15 | x 0.01 | 0.001 | 2.30 | I | 1120 | " |
| 94 | 0.083 | 0.025 | " | 0.15 | x 2.5 | " | " | 0.15 | x 2.5 | 0.001 | 2.30 | I | 1120 | " |

| Run No. | Intermediate Annealing Temperature (°C.) | Thickness after Final Cold Rolling (m/m) | Thickness Reduction Ratio at Final Cold Rolling (%) | Presence or Absence of Hot Maintenance during Final Cold Rolling | Presence or Absence of Tension Coating | Average Grain Size (m/m) | Magnetic Domain-Controlling Method | Flux Density B8 (T) | Watt Loss Kind | Watt Loss Measured (W/kg) | Remarks |
|---|---|---|---|---|---|---|---|---|---|---|---|
| 1 | / | 0.170 | 87.9 | effected | present | not measured | A | 1.93 | W15/50 | 0.41 | present invention |
| 2 | " | 0.170 | 87.9 | " | " | " | A | x 1.73 | W15/50 | 1.05 | comparison |
| 3 | " | 0.170 | 87.9 | " | " | " | A | x 1.84 | W15/50 | 0.75 | " |
| 4 | " | 0.170 | 87.9 | " | " | " | A | x 1.86 | W15/50 | 0.65 | " |
| 5 | " | 0.170 | 87.9 | " | " | " | A | 1.93 | W15/50 | 0.51 | " |
| 6 | " | 0.170 | 87.9 | " | " | " | A | 1.93 | W15/50 | 0.48 | " |
| 7 | " | 0.170 | 87.9 | " | " | " | A | 1.90 | W15/50 | 0.55 | " |
| 8 | " | 0.170 | 87.9 | " | " | " | A | x 1.85 | W15/50 | 0.70 | " |
| 9 | " | 0.170 | 87.9 | " | " | " | A | 1.93 | W15/50 | 0.40 | present invention |
| 10 | " | 0.170 | 87.9 | " | " | " | A | 1.93 | W15/50 | 0.41 | comparison |
| 11 | " | 0.170 | 87.9 | " | x absent | " | A | 1.94 | W15/50 | 0.55 | " |
| 12 | " | 0.170 | x 81.1 | " | present | x 5 | A | 1.92 | W15/50 | 0.45 | " |
| 13 | " | 0.170 | 89.4 | " | " | 20 | A | 1.92 | W15/50 | 0.39 | present invention |
| 14 | " | 0.170 | x 93.2 | " | " | x 65 | A | 1.90 | W15/50 | 0.53 | comparison |
| 15 | " | 0.170 | 87.9 | " | " | not measured | B | 1.93 | W15/50 | 0.41 | present invention |
| 16 | " | 0.170 | 87.9 | " | " | " | C | 1.93 | W15/50 | 0.41 | " |
| 17 | " | 0.170 | 87.9 | " | " | " | D | 1.93 | W15/50 | 0.41 | " |
| 18 | " | 0.170 | 87.9 | " | " | " | A | 1.93 | W15/50 | 0.39 | " |
| 19 | " | 0.170 | 87.9 | " | " | " | A | x 1.72 | W15/50 | 1.07 | comparison |
| 20 | " | 0.170 | 87.9 | " | " | " | A | x 1.87 | W15/50 | 0.62 | " |
| 21 | " | 0.170 | 87.9 | " | " | " | A | 1.93 | W15/50 | 0.50 | " |
| 22 | " | 0.170 | 87.9 | " | " | " | A | 1.90 | W15/50 | 0.55 | " |
| 23 | " | 0.170 | 87.9 | " | " | " | A | 1.93 | W15/50 | 0.38 | present invention |
| 24 | " | 0.170 | 87.9 | " | " | " | A | 1.93 | W15/50 | 0.41 | " |
| 25 | " | 0.170 | 87.9 | " | " | " | A | x 1.73 | W15/50 | 1.04 | comparison |
| 26 | " | 0.170 | 87.9 | " | " | " | A | x 1.83 | W15/50 | 0.80 | " |

TABLE 1-continued

| | | | | | | | | | | | |
|---|---|---|---|---|---|---|---|---|---|---|---|
| 27 | " | 0.170 | 87.9 | " | " | " | A | 1.93 | W15/50 | 0.52 | " |
| 28 | " | 0.170 | 87.9 | " | " | " | A | 1.90 | W15/50 | 0.56 | " |
| 29 | " | 0.170 | 87.9 | " | " | " | A | 1.93 | W15/50 | 0.40 | present invention |
| 30 | " | 0.285 | 87.6 | " | " | " | A | 1.94 | W17/50 | 0.87 | " |
| 31 | " | 0.285 | 87.6 | " | " | " | A | x 1.85 | W17/50 | 1.15 | comparison |
| 32 | " | 0.285 | 87.6 | " | " | " | A | x 1.87 | W17/50 | 1.10 | " |
| 33 | " | 0.285 | 87.6 | " | " | " | A | 1.94 | W17/50 | 0.95 | " |
| 34 | " | 0.285 | 87.6 | " | " | " | A | 1.91 | W17/50 | 0.99 | " |
| 35 | " | 0.145 | 88.8 | " | " | " | B | 1.93 | W15/50 | 0.36 | present invention |
| 36 | " | 0.145 | 88.8 | " | " | " | B | x 1.73 | W15/50 | 1.00 | comparison |
| 37 | " | 0.145 | 88.8 | " | " | " | B | x 1.83 | W15/50 | 0.75 | " |
| 38 | " | 0.145 | 88.8 | " | " | " | B | 1.93 | W15/50 | 0.48 | " |
| 39 | " | 0.145 | 88.8 | " | " | " | B | 1.90 | W15/50 | 0.51 | " |
| 40 | 1000 | 0.145 | 88.8 | " | " | " | B | 1.93 | W15/50 | 0.37 | present invention |
| 41 | 1000 | 0.145 | 88.8 | " | " | " | B | x 1.74 | W15/50 | 0.98 | comparison |
| 42 | 1000 | 0.145 | 88.8 | " | " | " | B | x 1.82 | W15/50 | 0.80 | " |
| 43 | 1000 | 0.145 | 88.8 | " | " | " | B | 1.93 | W15/50 | 0.36 | present invention |
| 44 | 1000 | 0.145 | 88.8 | " | " | " | B | 1.93 | W15/50 | 0.48 | comparison |
| 45 | 1000 | 0.145 | 88.8 | " | " | " | B | 1.90 | W15/50 | 0.51 | " |
| 46 | 1000 | 0.100 | 87.0 | " | " | " | B | 1.92 | W13/50 | 0.24 | present invention |
| 47 | 1000 | 0.100 | 87.0 | " | " | " | B | x 1.70 | W13/50 | 0.52 | comparison |
| 48 | 1000 | 0.100 | 87.0 | " | " | " | B | x 1.86 | W13/50 | 0.43 | " |
| 49 | 1000 | 0.100 | 87.0 | " | " | " | B | 1.92 | W13/50 | 0.33 | " |
| 50 | 1000 | 0.100 | 87.0 | " | " | " | B | 1.90 | W13/50 | 0.37 | " |
| 51 | 1100 | 0.145 | 88.8 | " | " | " | B | 1.93 | W15/50 | 0.36 | present invention |
| 52 | 1100 | 0.145 | 88.8 | " | " | " | B | x 1.72 | W15/50 | 1.04 | comparison |
| 53 | 1100 | 0.145 | 88.8 | " | " | " | B | x 1.83 | W15/50 | 0.75 | " |
| 54 | 1100 | 0.145 | 88.8 | " | " | " | B | 1.93 | W15/50 | 0.37 | present invention |
| 55 | 1100 | 0.145 | 88.8 | " | " | " | B | x 1.70 | W15/50 | 1.15 | comparison |
| 56 | 1100 | 0.145 | 88.8 | " | " | " | B | 1.90 | W15/50 | 0.53 | " |
| 57 | 1000 | 0.100 | 87.0 | " | " | " | B | 1.92 | W13/50 | 0.24 | present invention |
| 58 | 1100 | 0.100 | 87.0 | " | " | " | B | x 1.69 | W13/50 | 0.54 | comparison |
| 59 | 1100 | 0.100 | 87.0 | " | " | " | B | x 1.84 | W13/50 | 0.47 | " |
| 60 | 1100 | 0.100 | 87.0 | " | " | " | B | 1.92 | W13/50 | 0.33 | " |
| 61 | 1100 | 0.100 | 87.0 | " | " | " | B | 1.90 | W13/50 | 0.38 | " |
| 62 | / | 0.170 | 87.9 | " | " | " | A | x 1.65 | W15/50 | 1.25 | comparison (v.s. No. 1) |
| 63 | " | 0.170 | 87.9 | " | " | " | A | x 1.70 | W15/50 | 1.10 | comparison (v.s. No. 1) |
| 64 | " | 0.170 | 87.9 | " | " | " | A | x 1.66 | W15/50 | 1.20 | comparison (v.s. No. 18) |
| 65 | " | 0.170 | 87.9 | " | " | " | A | x 1.71 | W15/50 | 1.09 | comparison (v.s. No. 18) |
| 66 | " | 0.170 | 87.9 | " | " | " | A | x 1.65 | W15/50 | 1.24 | comparison (v.s. No. 24) |
| 67 | " | 0.170 | 87.9 | " | " | " | A | x 1.70 | W15/50 | 1.11 | comparison (v.s. No. 24) |
| 68 | 1000 | 0.145 | 88.8 | " | " | " | B | x 1.64 | W15/50 | 1.23 | comparison (v.s. No. 43) |
| 69 | 1000 | 0.145 | 88.8 | " | " | " | B | x 1.69 | W15/50 | 1.14 | comparison (v.s. No. 43) |
| 70 | 1100 | 0.145 | 88.8 | " | " | " | B | x 1.63 | W15/50 | 1.25 | comparison (v.s. No. 51) |
| 71 | 1100 | 0.145 | 88.8 | " | " | " | B | x 1.69 | W15/50 | 1.14 | comparison (v.s. No. 51) |
| 72 | / | 0.170 | 87.9 | " | " | " | A | x 1.93 | W15/50 | 0.40 | present invention (v.s. No. 1) |
| 73 | " | 0.170 | 87.9 | " | " | " | A | 1.93 | W15/50 | 0.44 | comparison (v.s. No. 1) |
| 74 | " | 0.170 | 87.9 | " | " | " | A | 1.93 | W15/50 | 0.39 | present |

TABLE 1-continued

| | | | | | | | | | | | |
|---|---|---|---|---|---|---|---|---|---|---|---|
| | | | | | | | | | | | invention (v.s. No. 1) |
| 75 | " | 0.170 | 87.9 | " | " | " | A | 1.93 | W15/50 | 0.38 | present invention (v.s. No. 18) |
| 76 | " | 0.170 | 87.9 | " | " | " | A | 1.93 | W15/50 | 0.42 | comparison (v.s. No. 18) |
| 77 | " | 0.170 | 87.9 | " | " | " | A | 1.93 | W15/50 | 0.37 | present invention (v.s. No. 18) |
| 78 | " | 0.170 | 87.9 | " | " | " | A | x 1.87 | W15/50 | 0.60 | comparison (v.s. No. 18) |
| 79 | " | 0.170 | 87.9 | " | " | " | A | x 1.71 | W15/50 | 1.10 | comparison (v.s. No. 18) |
| 80 | 1000 | 0.145 | 88.8 | " | " | " | B | x 1.86 | W15/50 | 0.62 | comparison (v.s. No. 40) |
| 81 | 1000 | 0.145 | 88.8 | " | " | " | B | x 1.70 | W15/50 | 1.14 | comparison (v.s. No. 40) |
| 82 | x 1000 | 0.145 | 88.8 | " | " | " | B | x 1.86 | W15/50 | 0.62 | comparison (v.s. No. 54) |
| 83 | x 1220 | 0.145 | 88.8 | " | " | " | B | x 1.71 | W15/50 | 1.12 | comparison (v.s. No. 54) |
| 84 | 1000 | 0.145 | x 80.9 | " | " | x 6 | B | 1.92 | W15/50 | 0.44 | comparison |
| 85 | 1000 | 0.145 | 87.9 | " | " | 25 | B | 1.93 | W15/50 | 0.34 | present invention |
| 86 | 1000 | 0.145 | x 93.1 | " | " | x 68 | B | x 1.87 | W15/50 | 0.60 | comparative |
| 87 | 1120 | 0.145 | x 80.9 | " | " | x 5 | B | 1.93 | W15/50 | 0.43 | " |
| 88 | 1120 | 0.145 | 87.9 | " | " | 30 | B | 1.93 | W15/50 | 0.34 | present invention |
| 89 | 1120 | 0.145 | x 93.1 | " | " | x 65 | B | x 1.87 | W15/50 | 0.59 | comparison |
| 90 | / | 0.285 | 87.6 | absent | " | not measured | A | 1.95 | W17/50 | 0.90 | present invention |
| 91 | " | 0.285 | 87.6 | " | " | " | A | x 1.84 | W17/50 | 1.18 | comparative |
| 92 | " | 0.285 | 87.6 | " | " | " | A | x 1.86 | W17/50 | 1.14 | " |
| 93 | " | 0.285 | 87.6 | " | " | " | A | 1.93 | W17/50 | 0.99 | " |
| 94 | " | 0.285 | 87.6 | " | " | " | A | 1.90 | W17/50 | 1.02 | " |

Note
Symbol " " same as above
Symbol "x" outside the scope of the present invention

EXAMPLE 2

Many slabs comprising 0.082% of C, 3.25% of Si, 0.075% of Mn, 0.0050% of P, 0.025% of S, 0.0245% of acid-soluble Al, 0.0085% of N, 0.13% of Sn, and 0.8% of Ni, with the balance being substantially Fe, were heated at 1100° to 1450° C. for 60 minutes and hot-rolled to 1.4 mm, and each hot-rolled sheet was annealed at 1120° C. for 90 seconds and cooled to normal temperature at a rate of 30° C./sec. Then the sheet was cold-rolled to a thickness of 0.170 mm. During the cold rolling, the maintaining of the temperature at 250° C. for 5 minutes was conducted 4 times. Then, the decarburization annealing was carried out at 850° C. for 150 seconds in an atmosphere comprising 75% of $H_2$ and 25% of $N_2$ and having a dew point of 65° C. An anneal separating agent composed mainly of magnesia was coated on the steel sheet and the sheet was heated to 1200° C. at a rate of 20° C./hr in an atmosphere comprising 85% of $H_2$ and 15% of $N_2$. Then the sheet was soaked at 1200° C. for 20 hours in an atmosphere of $H_2$. The flux density was measured. The relationship between the slab-heating temperature and the flux density is shown in FIG. 7.

Figure 7:
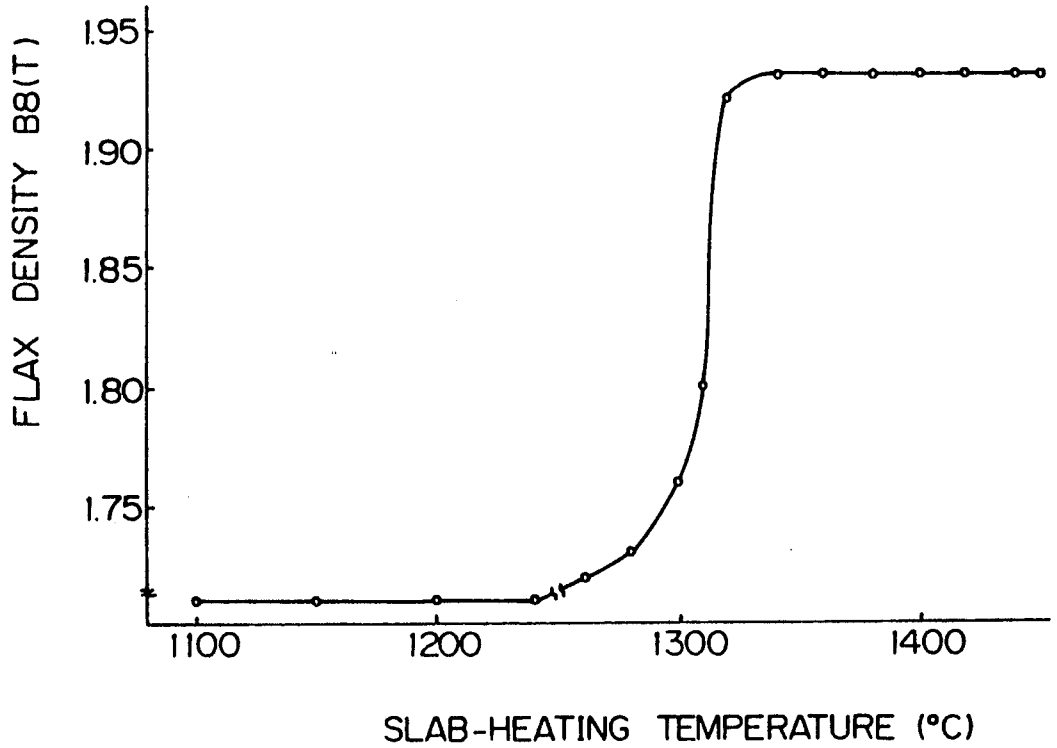

In FIG. 7, the slab-heating temperature is plotted on the abscissa and the flux density B8 (the flux density at a magnetizing force of 800 A/m) is plotted on the ordinate.

As apparent from the foregoing description, according to the present invention, a material having a very small watt loss, which is suitable for the production of a core of a small-watt loss transformer, can be supplied, and the loss of energy in electrical appliances such as a transformer can be greatly reduced and a great economical effect can be attained.

I claim:

1. A process for the preparation of a high-flux density, grain-oriented electrical steel sheet having a flux density of at least 1.88 T and an especially superior watt loss characteristic, which comprises the steps of:

heating at 1320° to 1430° C. a slab comprising 0.065 to 0.120% by weight of C, 2.8 to 4.5% by weight of Si, 0.045 to 0.100% by weight of Mn, 0.015 to 0.60% by weight of one or two elements selected from the group consisting of S and Se, 0.0150 to 0.0400% by weight of acid-soluble Al, 0.0060 to 0.0100% by weight of N, 0.03 to 0.25% by weight of Sn and 0.35 to 2.0% by weight of Ni, with the balance being substantially Fe and unavoidable impurities;

hot rolling the heated slab to form a hot-rolled steel strip;

cold rolling the hot rolled steel strip once or at least twice with an intermediate annealing, in which a final cold rolling of the steel strip is carried out at a thickness reduction ratio of 83% to 92%;

annealing the hot rolled steel strip or the cold rolled steel strip at a temperature of from 1030° C. to 1200° C. after the hot rolling and before the final cold rolling, and subsequently, rapidly cooling said annealed steel strip;

decarburization annealing the final cold rolled steel strip in a wet atmosphere containing hydrogen;

coating the decarburization annealed steel strip with an annealing separating agent composed mainly of magnesia;

winding the coated steel strip in the form of a coil;

finishing annealing the steel strip coil at a high temperature to cause secondary recrystallization;

removing the annealing separating agent from the finish annealed steel strip;

level annealing the finish annealed steel strip;

tension coating the finish annealed steel strip; and subjecting the surface of the steel strip to an artificial magnetic domain-controlling treatment in a direction orthogonal to the rolling direction after secondary recrystallization and before or after the tension coating or level annealing.

2. A process according to claim 1, wherein the slab further comprises at least one member selected from the group consisting of 0.03 to 0.08% by weight of Cu and 0.005 to 0.035% by weight of Sb.

3. A process according to claim 1 or 2, wherein the average grain size of crystal grains of the product in the rolled plane is adjusted to 11 to 50 mm.

* * * * *